United States Patent [19]

Stevens

[11] Patent Number: 4,645,427

[45] Date of Patent: Feb. 24, 1987

[54] METERING PUMP ASSEMBLY

[76] Inventor: William J. Stevens, 23/25 Woodstock St., Bondi Junction, Australia

[21] Appl. No.: 789,361

[22] Filed: Oct. 22, 1985

Related U.S. Application Data

[63] Continuation of Ser. No. 610,194, May 16, 1984, abandoned, which is a continuation of Ser. No. 366,316, Apr. 7, 1982, abandoned.

[30] Foreign Application Priority Data

Apr. 10, 1981 [AU] Australia ..... PE8407

[51] Int. Cl.[4] ..... F04F 1/18; F04F 3/00

[52] U.S. Cl. ..... 417/108; 417/109; 417/121

[58] Field of Search ..... 417/108, 109, 121, 150, 417/90, 63; 73/861.01

[56] References Cited

U.S. PATENT DOCUMENTS

| | | | |
|---|---|---|---|
| 532,699 | 1/1895 | Pohlé | 417/109 |
| 2,744,065 | 5/1956 | Lacey | 417/108 X |
| 2,786,602 | 3/1957 | Kamm | 417/108 X |
| 3,028,817 | 4/1962 | Cunetta | 417/108 |
| 3,592,560 | 7/1971 | Mitchell | 417/108 X |
| 3,930,755 | 1/1976 | Lahr et al. | 417/130 X |
| 4,147,298 | 4/1979 | Leemhuis | 73/861.01 |
| 4,245,475 | 1/1981 | Girden | 417/108 X |
| 4,297,081 | 10/1981 | Irvin | 417/63 |

*Primary Examiner*—Carlton R. Croyle
*Assistant Examiner*—Theodore Olds
*Attorney, Agent, or Firm*—Leydig, Voit & Mayer

[57] ABSTRACT

An air lift pump delivers liquid from a sump to an elevated tundish. The tundish is divided by weirs into a plurality of compartments in cascade. Surplus liquid overflows from the upper compartments back to the sump to produce a constant depth in the lowest compartment. A second air lift pump operating at a predetermined immersion depth delivers a steady flow of liquid from the lowest compartment.

25 Claims, 3 Drawing Figures

METERING PUMP ASSEMBLY

This application is a continuation of application Ser. No. 610,194, filed 5/16/84, now abandoned, which is a continuation of application Ser. No. 366,316, filed 4/7/82, now abandoned.

FIELD OF THE INVENTION

In many industrial and laboratory processes there is a need for the provision of a steady flow of liquid, for example, a reagent or a liquid being subjected to some treating process. Typical of the many instances which could be quoted are, for example, the intravenous feeding of regular doses of saline solution to a critically ill person, the dosing of concentrated liquid chlorine solution into the filter return line of a swimming pool, or the similar dosing of additive solutions into the feed water for a steam generator.

Hitherto, positive displacement metering pumps have been utilized for the provision of such liquid flows but such pumps are expensive especially when, as is usually the case, it is desired that the particular flow rate may be adjusted to suit conditions prevailing for the time being in the system in which the flow is established.

SUMMARY OF THE INVENTION

In view of the foregoing the present invention was devised to provide a low maintenance, readily adjustable and a relatively inexpensive metering pump assembly adapted to purposes of the kind mentioned above.

The invention is based on the appreciation that an air lift pump having no moving parts is emminently suitable provided the air supply to the pump is constant and other factors including the immersion depth of the pump are likewise constant.

The invention consists in a constant output or metering pump assembly comprising a pump chamber such as or, preferably, including an elevated tundish, preferably with an overflow return to a source or means of supplying a liquid to the chamber, such as a sump and may include a supply or first pump to draw liquid from the sump and deliver it to the pump chamber or tundish, an, air lift pump, which, when the supply pump is used, is preferably of lesser capacity than the supply pump, to draw liquid from the tundish for delivery from the assembly means to maintain a predetermined liquid level in the chamber and means to adjust the immersion depth of the airlift pump in the chamber.

DETAILED DESCRIPTION OF PREFERRED EMBODIMENTS

Figure 1:
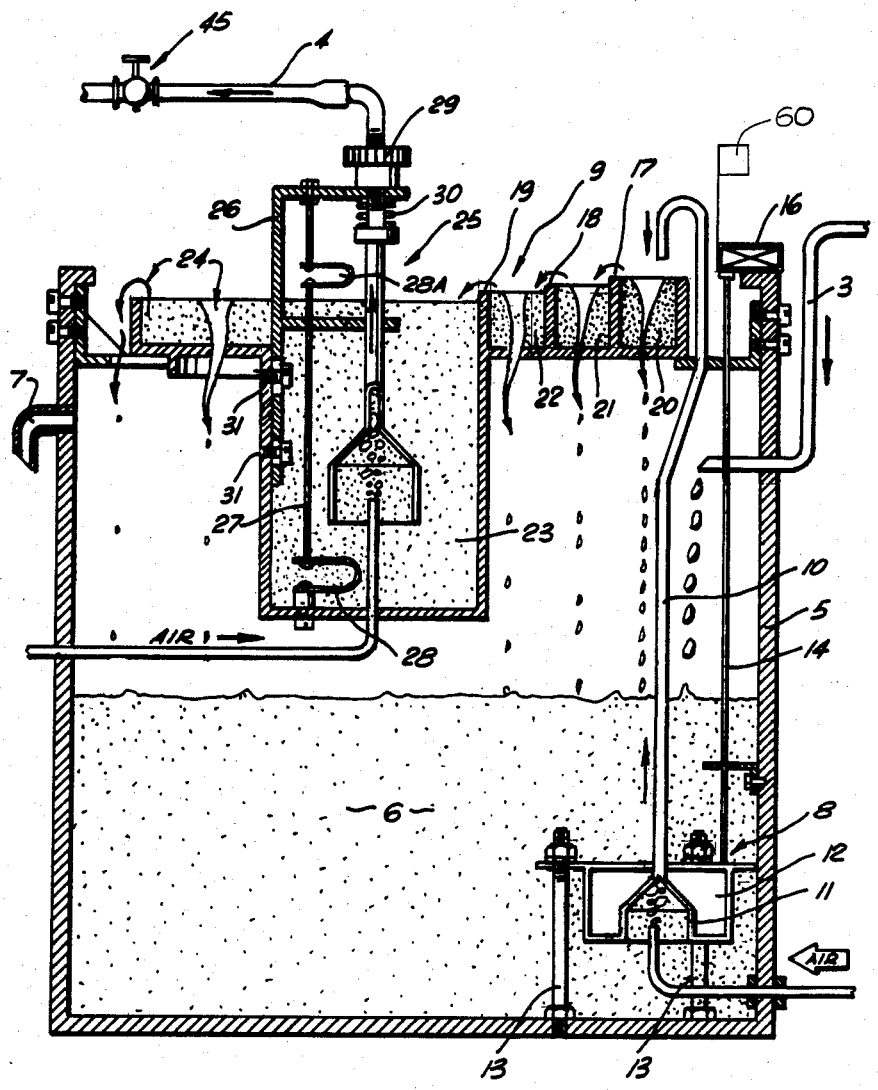
FIG. 1 is a diagrammatic sectional elevational view of a pump assembly according to the invention.
Figure 1A:
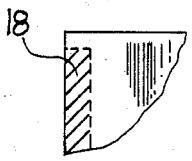
FIG. 1*a* is an elevational fragmentary enlargement of an embodiment of the invention showing the relationship between a side wall and a contiguous weir.

The pump assembly illustrated in FIG. 1 is adapted to receive liquid as a batch or from an input conduit 3 at an intermittent or fluctuating rate and to deliver liquid through an output conduit 4 at a steady predetermined rate.

To that end the assembly comprises a relatively large sump 5 adapted to hold a charge of liquid 6 of fluctuating depth. In the event that in the long term the supply of liquid from conduit 3 exceeds the output by way of conduit 4, surplus liquid may flow to storage or to waste by way of overflow outlet 7.

A first air lift pump 8 draws liquid from the charge 6 and delivers it to an elevated reservoir or tundish 9.

The pump 8 comprises a lift tube 10 having a bell-shaped lower end of air trap 11 defining part of the undersurface of a float 12 having sufficient flotation when fully immersed to support the weight of the pump and the liquid flowing in lift tube 10. The pump 8 slidably engages guides 13 so that if in the long term the inflow of liquid is less than the outflow, so that the level of liquid in the sump drops, then the pump 8 may sink and in so doing release the pressure between a push-rod 14 carried by the pump and a microswitch 16 controlling the operation of an air compressor whereby air is delivered to the pump 8. This microswitch may also activate an alarm 60 to signify that the pump has stopped or alternately any other electrically operated function according to requirements may be started or stopped.

Air is fed into end 11 of the lift tube by an air compressor (not shown) which is preferably of the vibrating diaphragm type because such compressors are not only inexpensive but have a steady output rate.

The tundish 9 is divided by internal weirs 17, 18 and 19 respectively, of successively lesser height into four compartments 20, 21, 22 and 23 respectively. Surplus liquid in each of compartments 20, 21 and 22 may overflow into the sump 5 over side walls which are slightly higher than the internal weir between the relevant compartment and the next lower compartment in the cascade. Surplus liquid in the compartment 23 may also overflow into the sump 5 as indicated at 24 so that the liquid level in compartment 23 is substantially constant.

The purpose of the upstream compartments 20, 21 and 22 is to ensure that the overflow rate from compartment 23 is substantially constant, notwithstanding variations in the output from pump 8 in consequence of variations of the liquid level in sump 5. When the liquid level in sump 5 is a minimum so that the output from pump 8 is a minimum there is virtually no overflow from compartments 20, 21 or 22 and the liquid delivered by the pump 8 simply cascades across weirs 17, 18 and 19 into the compartment 23 but does so at a rate which causes some overflow from that compartment. If the sump 8 output increases overflow commences from compartment 22 and then 21, and if the increase in pump output is sufficient also from compartment 20 which has the effect of bleeding off the increased pump output so that the flow into compartment 23 is rendered more nearly constant. This means, of course, that the head causing flow over its side walls is substantially constant as, in turn, is the depth of liquid in the compartment.

A second air lift pump 25 is mounted at a pre-set immersion depth, that is to say, at a pre-set elevation relative to the floor of the compartment 23, to deliver a substantially constant outflow of liquid from the tundish to whatever apparatus is being fed with liquid by the pump assembly.

The pump 25 is carried by a vertically slidable saddle 26 which is supported by a strut 27 including curved bi-metallic elements 28 and 28A respectively.

The immersion depth of pump 25, in particular, the lift tube of the pump, may be adjusted by means of an abutment nut 29 screw-threaded upon an upper portion of the pump's lift tube and which positions the lift tube and air trap relative to the saddle 26 against the effect of a loading spring 30.

The purpose of the bi-metallic element 28A is to effect minor positional adjustment of the saddle 26 to compensate for temperature changes in the ambient atmosphere. Variations in air temperature cause variation in the quantity of air delivered by the compressor and, without such compensation, the delivery of liquid from the pump 25 would likewise vary.

The purpose of the bi-metallic element 28 is to effect similar compensation for variations in the solution or liquid temperature which would also cause variations in the pump delivery rate, the warmer the liquid the greater the delivery rate although where extreme accuracy is not essential and to reduce cost the thermostats may be omitted.

The principle variables in an air lift pump are, air quantity and pressure, delivery head, immersion depth, delivery tube diameter, and to a lesser extent, temperature, and barometric pressure. Should all these variables remain unchanged then a liquid-gas phase will exist in the system which will be constant and therefore the amount of liquid being delivered must also be constant.

The pump assembly seeks to stabilize variables except immersion depth as this variable is not only readily controllable but it gives a consistent increase or decrease in delivery rate for each unit increase or decrease in depth.

However if the range of this capacity needs to be changed it may readily be accomplished by providing a larger or smaller diameter delivery tube 4 and the change in delivery rates will again be consistent with each unit change in the immersion depth over a higher or lower range depending on the increase or decrease in diameter of the delivery tube 4.

If desired, a valve 45, preferably a needle valve may be provided further to adjust the delivery rate from pump 25, such a valve at reduced settings would have a similar effect to the provision of a smaller diameter delivery tube 4.

Change in the air supply will also change the delivery rate but is not consistent with unit change as a higher air supply can increase the delivery rate up to a point where further increase begins to reduce the delivery rate, to a stage where the liquid delivery rate is zero. At this point there is merely capacity in the delivery tube 4 to take the air being supplied at that particular amount and pressure and the liquid-gas ratio may be said to be equal to zero. By means of a valve adjustment or otherwise an air supply rate is initially chosen which gives a maximum or desired liquid delivery rate and henceforth the air supply is no longer changed and remains fixed.

Figure 2:
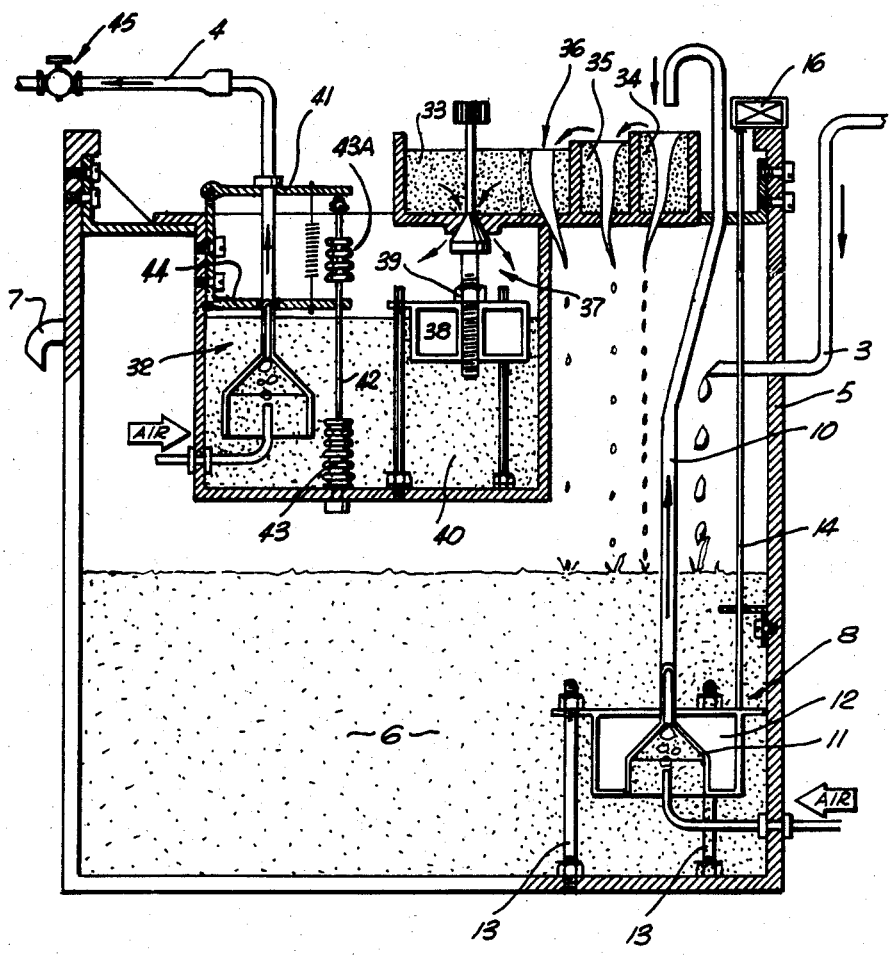
FIG. 2 is a view similar to FIG. 1 of a second embodiment of the invention.

The pump assembly illustrated by FIG. 2 of the drawings comprises sump, first pump, push-rod and microswitch arrangements similar to the corresponding components of the FIG. 1 embodiment. Therefore the corresponding components are not described further hereinafter but bear reference numerals corresponding to those of the same components of FIG. 1.

In the present instance however pump 32 (corresponding in function to pump 25 of the FIG. 1 embodiment) is fixed in altitude relative to the floor of the compartment 40, being that part of the tundish holding the pool of liquid from which pump 32 draws its supply except for temperature compensating adjustment as described below.

In the FIG. 2 embodiment the variation or adjustment of immersion depth of the pump is therefore achieved by altering the depth of the liquid and this is achieved by controlling the flow from an upper chamber 33 of the tundish, which receives liquid by way of overflow upper cascade compartments 34 and 35 from pump 8 and which is equipped with an overflow weir at 36, by means of a float controlled valve 37.

The cascade compartments 34 and 35 function in exactly the same way as compartments 20, 21 and 22 of the FIG. 1 embodiment and ensure that there is always substantially the same liquid level in compartment 33.

Valve 37 is carried by a float 38 and the spacing between the valve 37 and the float may be altered by means of adjustment nut 39 to provide for closure of the valve at pre-selected float altitudes, that is to say, when there is a pre-selected depth of liquid in the compartment 40.

Thus, once again, the arrangement provides for substantially steady outflow by way of output conduit 4 and, may include, valve 45.

The primary adjustment of the immersion depth of pump 32 is thus achieved by adjustment of the operation of the valve 37. However, if desired, the pump 32 may be mounted upon a swing arm 41 supported by a strut 42 which, in turn, is supported by closed thermo-responsive bellows 43 and 43A to effect positional adjustment of the pump 32 in consequence of expansion or contraction of the bellows caused by temperature changes in the ambient air and in the liquid being pumped. For preference a fixed guide arm 44 is pierced by the lift tube of pump 32 with sufficient clearance to hold the lift tube substantially vertical whilst allowing movement engendered by swing movement of the arm 41.

Figure 3:
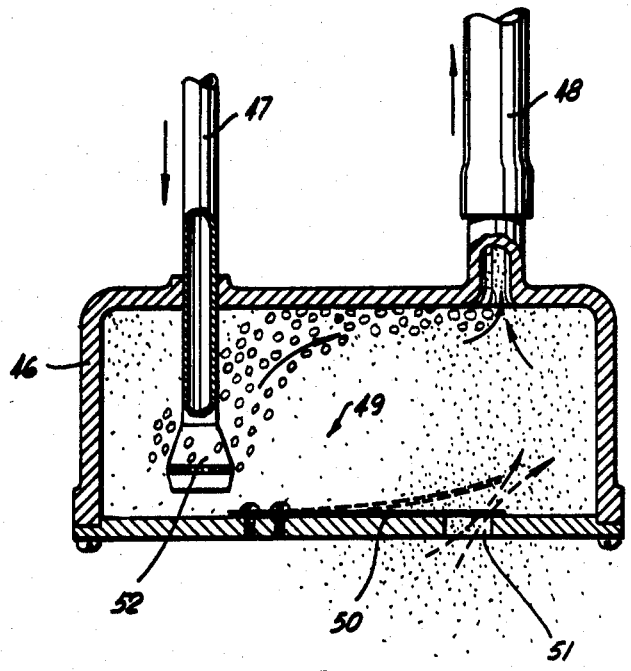
FIG. 3 is a sectional view of part of an air lift pump.

In modifications of the above-described embodiments of the invention, the airlift pumps, or one or other of them, may be replaced by a pump of the kind illustrated in FIG. 3. That pump comprises a foot chamber 46 into which air may be fed by way of a flexible supply tube 47 to which is attached a diffuser 52 consisting of a closed foot piece with a large number of small holes at its bottom perimeter which liberates the air as a very large number of very small bubbles which together have a very large combined surface area. This has the effect of the air combining with a larger quantity of liquid thus increasing the efficiency of the pump and reducing the maximum bubble size in the pumping chamber, which for metering purposes reduces the pulsation effect in the chamber 32.

A lift tube 48 with a diameter chosen to suit the pumping range required extends from the chamber 46 and liquid to be elevated may enter this chamber through a non-return valve 49. The advantages of providing such a closed foot chamber and non-return valve are that a shallower chamber may be used, it increases again the pump efficiency, it increases the possible head and the flow rate, and it overcomes the tendency of an open ended chamber to stall. In the case of stalling, the air/liquid in the tube 48 sometimes requires greater air pressure to elevate it, and the bubble in the chamber becomes larger than the chamber itself and the excess air continually escapes from the bottom of the chamber without activating the pump.

In the illustrated embodiment the non-return valve 49 merely comprises a flexible plastic flap 50 adapted to cover a hole 51 in the floor of the chamber 46 but it will be appreciated that any conventional non-return valve could be utilised.

In other embodiments of the invention the primary setting of the immersion depth of the second air lift pump may be effected by raising or lowering the entire tundish from which it draws liquid rather than by raising and lowering the pump in the manner of, for example, the FIG. 1 embodiment.

I claim:

1. A constant output pump assembly comprising a pump chamber, means to supply liquid to said pump chamber, means to maintain a predetermined liquid level in said pump chamber, an airlift pump comprising a lift tube and adapted to deliver liquid from said pump chamber to an outlet means, and means to adjust the immersion depth of said lift tube in said chamber to thereby regulate the output of said pump.

2. An assembly according to claim 1 wherein said immersion depth adjustment means includes at least one of a means for vertically adjusting the relative positions of said pump and said pump chamber and a valve means adjustable to alter the level of liquid in said chamber, said adjustable valve means responsive to the depth of liquid in said chamber.

3. An assembly according to claim 1 wherein said outlet means is located remote from said pump chamber.

4. A constant output pump assembly comprising a pump chamber; means to supply liquid to said pump chamber; means to maintain a predetermined liquid level in said pump chamber; an airlift pump adapted to deliver liquid from said chamber, said airlift pump comprising a lift tube, an air trap at the bottom of said lift tube and an air supply tube having its outlet below and remote from said lift tube to liberate air as free rising bubbles in the liquid outside of said lift tube for entrapment by said air trap and conduction thereby into said lift tube; and means to adjust the immersion depth of said lift tube in said chamber to thereby regulate the output of said pump.

5. An assembly according to claim 4 wherein said predetermined level maintaining means includes a tundish to receive liquid from said liquid supply means for delivery of at least a part of the liquid to said pump chamber.

6. An assembly according to claim 5 wherein said liquid supply means includes a supply pump having a delivery rate greater than that of said airlift pump to transfer liquid from a sump to said pump chamber.

7. An assembly according to claim 6 wherein said tundish includes at least one weir for the overflow return of the remainder of the liquid to said sump.

8. An assembly according to claim 6 wherein said predetermined level means further includes an overflow weir partly defining the pump chamber permitting excess liquid delivered to the pump chamber to return to the sump.

9. An assembly according to claim 6 wherein said supply pump is an airlift pump.

10. An assembly according to claim 4 wherein said adjustment means includes a temperature compensating means.

11. An assembly according to claim 6 further including means responsive to the level of liquid in the sump for terminating operation of both pumps when the level of liquid falls to a predetermined minimum depth.

12. An assembly according to claim 11 further including alarm means responsive to the level of liquid in the sump, said alarm means providing a signal when the liquid level in the sump falls to an alternate predetermined depth higher than said predetermined minimum depth.

13. An assembly according to claim 4 wherein said airlift pump comprises a foot chamber, from which said lift tube extends upwardly and a non-return valve for the admission of liquid into said foot chamber.

14. An assembly according to claim 13 wherein the outlet of said air supply tube comprises a diffuser to release the air as a plurality of small bubbles.

15. An assembly according to claim 4 wherein the means for adjustment of the immersion depth of said lift tube comprise means for vertically positioning said lift tube relative to said pump chamber.

16. An assembly according to claim 4 further including, an outlet means located remote from said pump chamber.

17. A constant output pump assembly according to claim 4 wherein said means to maintain a predetermined liquid level in said pump chamber include a valve means adjustable to alter the level of liquid in said chamber, said adjustable valve means responsive to the depth of liquid in said chamber.

18. An assembly according to claim 17 wherein said valve means is operatively associated with said means to maintain a predetermined liquid level.

19. An assembly according to claim 17 wherein said valve means is operatively associated with said liquid supply means.

20. An assembly according to claim 18 wherein said means to maintain a predetermined level includes a tundish to receive liquid from said supply means for delivery of a part of the liquid to the pump chamber.

21. An assembly according to claim 20 wherein said adjustable valve means is a float operatively associated with said tundish.

22. An assembly according to claim 20 wherein said tundish includes at least one weir for the overflow return of the remainder of the liquid to a sump supplying said tundish.

23. A pump assembly comprising a pump chamber, means to supply liquid to said pump chamber, level control means to maintain a predetermined level in said pump chamber, said level control means comprising a float operated valve situated within said pump chamber and acting directly upon said liquid supply means, an air lift pump comprising a lift tube, and means for vertically adjusting said lift tube of said airlift pump located within said pump chamber relative to the predetermined level to correspondingly adjust the assembly output flow rate.

24. An assembly according to claim 23 wherein said float operated valve is adjustable.

25. An assembly according to claim 17 wherein said outlet is located remote from said pump chamber.

* * * * *